US005783766A

United States Patent [19]

Tanaka

[11] Patent Number: 5,783,766

[45] Date of Patent: Jul. 21, 1998

[54] MUSICAL SOUND PRODUCING DEVICE IN ELECTRONIC MUSICAL INSTRUMENT

[75] Inventor: Jiro Tanaka, Shizuoka, Japan

[73] Assignee: Kabushiki Kaisha Kawaigakki Seisakusho, Shizuoka, Japan

[21] Appl. No.: 901,971

[22] Filed: Jul. 29, 1997

[30] Foreign Application Priority Data

Jul. 29, 1996 [JP] Japan ..... 8-214948

[51] Int. Cl.[6] ..... G10H 1/057; G10H 1/22

[52] U.S. Cl. ..... 84/618; 84/627; 84/DIG. 2; 381/61

[58] Field of Search ..... 84/601, 602, 603–607, 84/615–620, 626–633, 653–658, 662–665, 678–690, 701–711, DIG. 1, DIG. 2, DIG. 27; 381/61–65

[56] References Cited

U.S. PATENT DOCUMENTS 4,481,851 11/1984 Swain et al. ..... 84/DIG. 2
4,570,520 2/1986 Deutsch et al. ..... 84/DIG. 2
4,703,680 11/1987 Wachi et al. ..... 84/DIG. 2
5,369,224 11/1994 Miyata ..... 84/662

*Primary Examiner*—Stanley J. Witkowski
*Attorney, Agent, or Firm*—Sughrue, Mion, Zinn, Macpeak & Seas, PLLC

[57] ABSTRACT

A musical sound producing device in an electronic musical instrument of stereophonic sampling system, including: an oscillator using status memory for storing each order of right and left oscillators which are being used for sound production, in accordance with an order of the sound production; a number-of-produced-sound memory register for storing each number of stereophonic sounds and a monophonic sound which are being produced at the same time by the oscillators memorized in the oscillator using status memory; and an oscillator assigning section for performing calculation in accordance with the numbers of the stereophonic sounds and the monophonic sound stored in the number-of-produced-sound memory register, switching at least one stereophonic sounds being produced over to monophonic sound, by damping an oscillator, when a musical sound is newly keyed on under a condition that the number of oscillators which are being used reaches a total number of oscillators, and assigning an oscillator damped by switching to produce the musical sound which is newly keyed on.

17 Claims, 3 Drawing Sheets

MUSICAL SOUND PRODUCING DEVICE IN ELECTRONIC MUSICAL INSTRUMENT

BACKGROUND OF THE INVENTION

1. Field of the Invention

This invention relates to a musical sound producing device in an electronic musical instrument.

2. Background

Recently, for instance, electronic pianos of stereophonic sampling system have been popularly employed. In the stereophonic sampling system, the sound source is handled as follows. In the case where, as in the case of a piano, the output of a sound producing element is great, and in the case where it is required to express sounds to give the feeling of being at a live performance as in the case of strings, the sounds produced are recorded as stereophonic (right and left) sounds.

And, in a musical sound producing device in an electronic musical instrument, data on both channels thus recorded are sampled and held as sound source data, and in response to key-on data both data are read to produce sounds through right and left loudspeakers, giving the feeling of spread of the original sounds and the feeling of being at a live performance thereof.

Hence, in the case of the oscillators (or digital control oscillators) of an electronic musical instrument of stereophonic sampling system, in order to produce one sound, it is necessary to provide right and left oscillators; that is, in order to produce a number of sounds, it is accordingly necessary to provide a number of oscillators. Hence, the resultant electronic musical instrument is considerably high in manufacturing cost.

On the other hand, a monophonic sampling system is disadvantageous in that it is somewhat poor in tonal quality; however, it is advantageous in that it needs only one oscillator to produce one sound; that is, in the case where it is required to produce a number of sounds, the number of oscillators may be a half of that which are required in the case of the stereophonic sampling system.

SUMMARY OF THE INVENTION

Accordingly, an object of the invention is to eliminate the above-described difficulties accompanying a conventional electronic musical instrument.

The foregoing object of the invention has been achieved by the provision of a musical sound producing device in an electronic musical instrument of stereophonic sampling system which, according to the invention, includes: an oscillator using status memory for storing each order of right and left oscillators which are being used for sound production, in accordance with an order of the sound production; a number-of-produced-sound memory register for storing each number of stereophonic sounds and a monophonic sound which are being produced at the same time by the oscillators memorized in the oscillator using status memory; and an oscillator assigning section for performing calculation in accordance with the numbers of the stereophonic sounds and a monophonic sound stored in the number-of-produced-sound memory register, switching at least one stereophonic sounds being produced, to damp an oscillator, over to monophonic sound when a musical sound is newly keyed on under a condition that the number of oscillators which are being used reaches a total number of oscillators, and assigning an oscillator damped by switching to produce the musical sound which is newly keyed on.

In the musical sound producing device, the oscillator, which is damped when the oscillator assigning section switches the stereophonic sounds over to the monophonic sound and assigns the oscillator to produce the musical sound newly keyed on, is determined in accordance with a comparison of the number of oscillators which are producing right monophonic sounds with the number of oscillators which are producing left monophonic sounds.

Alternatively, in the musical sound producing device, the oscillator, which is damped when the oscillator assigning section switches the stereophonic sounds over to the monophonic sound and assigns the oscillator to produce the musical sound newly keyed on, is determined in accordance with a frequency range of the stereophonic sounds which have been produced.

Sound has the following characteristic: For instance, in the case of a piano, the sound produced thereby is attenuated in accordance with the lapse of time. Hence, in the case where a number of sounds are produced, even if some of the sounds become monophonic sounds, this fact is not sensed; that is, they will not greatly affect the musical performance.

As was described above, when a key is depressed while all the oscillators are producing sounds, two oscillators which produced sounds earliest are selected, and the right or left oscillator is damped to obtain a monophonic sound.

The two oscillators are used for production of the sound of the key newly depressed; that is, stereophonic sounds are obtained. Thus, in the musical sound producing device of the invention, with the oscillators effectively utilized, the number of sounds produced at the same time is increased.

Therefore, the oscillators of the sounds which are produced at the same time, are stored in the oscillator using status memory in the order of sound production of the right and left oscillators. Stereophonic sounds and monophonic sounds which are being produced, are stored in the number-of-produced-sound memory register.

Hence, whenever a key is newly operated on, a control section refers to the number-of-produced-sound memory register, to detect the number of oscillators which are being used, from the number of produced stereophonic and monophonic sounds. When more than one oscillator are not in operation, two of them are assigned to the key which is newly operated on, to obtain stereophonic sounds.

On the other hand, there is a case where all the oscillators are being used at the same time. In this case, two sounds which were produced earliest are selected, and the right or left oscillators of the two sounds thus selected are damped to obtain monophonic sounds, and the remaining two oscillators are assigned to the sound which is keyed on, to obtain stereophonic sounds.

As is seen from the above description, the number of oscillators to produce of sounds at the same time may be small, and the operation of the musical sound producing device is controlled in accordance with the suitable program, and therefore it is unnecessary to improve its hardware so much. Therefore, the musical sound producing device is small in the number of oscillators, and accordingly low in manufacturing cost.

In the device of the invention, for instance among thirty-two (32) sounds which are produced at the same time, only two sounds which were produced earliest are stopped; more specifically only two sounds in one of the channels are stopped. Hence, the performer will scarcely notice it, and the fact that the number of oscillators to be damped is small, scarcely affects the tonal quality of the music. In the case of an electronic piano or organ, the stoppage of the two sounds will scarcely affect the performance because the sound produced thereby is attenuated with the lapse of time.

DETAILED DESCRIPTION OF THE PREFERRED EMBODIMENT

A preferred embodiment of an electronic musical instrument of the invention will now be described in detail with reference to the drawings.

As was described before, FIG. 1 shows the whole arrangement of the electronic musical instrument of the invention.

Figure 1:
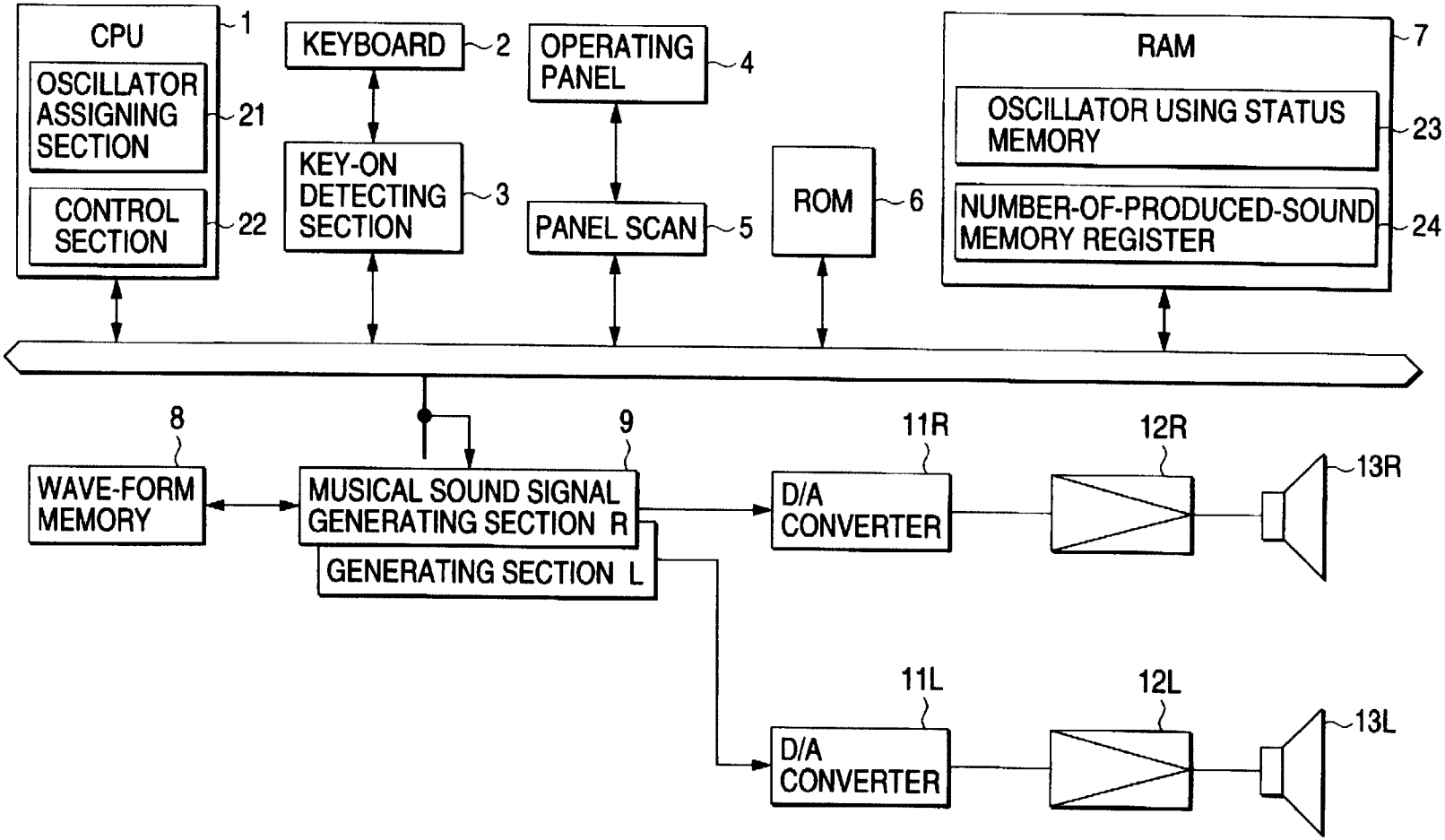
FIG. 1 is a block diagram, partly as an explanatory diagram, showing the whole arrangement of an electronic musical instrument according to the invention.

In FIG. 1, a CPU (central processing unit) 1 reads a control program from a program memory section in a ROM (read only memory) 6 through address buses and data buses, and executes the program to control a number of elements in the electronic musical instrument.

That is, the CPU 1 converts parameters, such as key on/off actions detected by a key-on detecting section 3, and tone colors etc. obtained by panel scanning, into a sound production starting instruction, a sound producing ending instruction, and a tone color changing instruction, etc., and send them through an interface circuit to right and left musical sound signal producing sections 9 including a plurality of oscillators, thereby controlling sounds.

The CPU 1 performs the assignment of oscillators according to the number of sounds which are produced at the same time. For this purpose, the CPU 1 has an oscillator assigning section 21 and a control section 22.

The oscillator assigning section 21 controls to assign, in accordance with the number of stereophonic and monophonic sounds which are produced at the same time, oscillators to a sound which is newly keyed on. For instance, in the case where a key is newly depressed while all of the oscillators are being producing sounds at the same time, the CPU 1 refers to an oscillator using status memory 23, to select two sounds which were produced earliest, and damps each one of the right and left oscillators of the two sounds, and assigns the oscillators to the key newly depressed, for production of stereophonic sounds.

The control section 22 performs the control of the whole electronic musical instrument. More specifically, the control section 22 performs to write data in the oscillator using status memory 23 and a number-of-produced-sound memory register 24 or to read data therefrom, and controls a function assigning section to operate the assignment of function, and controls the sound producing/stopping timing.

A keyboard 2 is an assembly of keys and key switches through which key-on and key-off operations of the performer are transmitted to the CPU 1. More specifically, the key board 2 includes: a plurality of keys and key switches which are operated on and off in response to key-on and key-off operations; and a key scan circuit for detecting the on-off states of those switches.

The key-on detecting section 3 detects the key-on and key-off operations of the performer; that is, it detects key on/off data, and transmits the key-on/off data thus detected together with the key number to the musical sound signal producing sections 9. The CPU 1 operates to store the key on/off data in an event buffer of a RAM (random access memory) 7.

Further in FIG. 1, reference numeral 4 designates an operating panel. Various switches such as a mode selecting switch, a tone color selecting switch adapted to select tone colors corresponding to a variety of musical instruments, a volume control switch, and LED indicators indicating states of the electronic musical instrument, are mounted on the operating panel.

The panel scan circuit 5 is built in the operating panel 4. The panel scan circuit 5 detects the set and reset states of those switches mounted on the operating panel 4. When there is a panel switch which is turned on, the panel scan circuit 5 detects the data of the panel switch, and stores it in the RAM 7 under the control of the CPU 1.

In the ROM 6, the control program of the CPU 1 is stored, and a variety of fixed data such as tone color data used by the CPU are stored. In addition, in the ROM 6, musical sound control parameters, which the oscillators in the musical sound signal producing section 9 read out, are also stored.

The RAM 7 temporarily stores data which are handled by the CPU 1, and various registers, counters and flags for controlling the electronic musical instrument are set up. In addition, a work area used by the CPU, and registers for storing status data and control data are assigned to the RAM 7.

The RAM 7 includes the oscillator using status memory 23 to which the oscillator assigning section 21 refers when the oscillator assigning section 21 performs the assignment of the oscillators. The oscillator using status memory 23 stores the oscillators which are being used, in the order of sound production time separately according to right and left stereophonic and monophonic sounds.

The number-of-produced-sound memory register 24 stores the total number (m) of oscillators, the number (S) of sounds being produced in a stereophonic mode, and the number (M) of sounds being produced in a monophonic mode. As the number of sounds produced changes, the contents of the register 24 is accordingly rewritten by the control section 22, and the register 24 is referred when the oscillator assigning section 21 performs the assignment of the oscillator.

The musical sound signal producing sections 9 include the plurality of right and left oscillators for producing musical sounds, and a filter for controlling the frequency characteristic of a waveform. In response to a sound production starting instruction from the control section 22, the musical sound signal producing sections 9 read musical sound waveform data from the wave-form memory 8, and subjects the musical sound wave-form data to filtering, and then to amplitude enveloping, to output a musical signal.

D/A (digital-to-analog) converters 11R and 11L operate to convert digital musical sound signals of right and left channels into analog musical sound signals. The analog musical signals outputted by the D/A converters 11R and 11L are applied through right and left amplifiers 12R and 12L to right and left loudspeakers 13R and 13L, so that they are produced as musical sounds.

The assignment of oscillators of the musical sound signal producing sections 9 of the invention will be described. The assignment of oscillators will be described with reference to one frequency band, because it is not dependent on the difference between frequency bands.

If it is assumed that, in the musical sound signal producing sections 9, the total number of the oscillators is represented by "m", and the number of stereophonic sounds which are produced at the same time is represented by "S", then the maximum number of sounds produced at the same time is (m/2) in the case where two (right and left) oscillators are required per stereophonic sound. That is, where m/2 sounds are produced, all the oscillators are being used.

Therefore, when $2\times S \leqq m-2$, at least two oscillators not used yet are available. Therefore, among the remaining oscillators, two oscillators are assigned to a key (sound) newly depressed (keyed on), so that stereophonic sounds are produced.

On the other hand, in the case where, under the condition that m/2 sounds are being produced, a key is newly operated, all of the oscillator are being used; that is, no oscillator is available which can be assigned to the key thus operated. Hence, the oscillator assigning section 21 refers to the oscillator using status memory 23, and damps each one of the right and left oscillators which produced stereophonic sounds earliest and next earliest, to obtain a monophonic sound.

The two oscillators thus damped are employed to produce the sound in a stereophonic mode which has been keyed on. Accordingly, the number of monophonic sounds is increased by two (2), while the number of stereophonic sounds is decreased by two (2); however, since one stereophonic sound is added, the total number of sounds which are produced at the same time is (m/2+1).

In the case, where a key-on operation is carried next, similarly as in the above-described case, each one of the channels of two stereophonic sounds which were produced next to the two sound which had been stopped before, is stopped, so that two oscillators which are not in operation are assigned to two new sounds. Hence, the total number of sounds which are produced at the same times is (m/2+2).

As is apparent from the above description, in the case where the n-th key-on operation is carried out, the total number of sounds which are produced at the same time is (m/2+n), and 2n sounds are monophonic sounds of single channel, and (m−2n)/2 sounds are stereophonic sounds of both channels.

As was described above, when the number of sounds produced at the same time exceeds m/2, then two sounds are changed into monophonic sounds beginning with the earliest sounds, and the oscillators whose sound productions are suspended are used for the stereophonic sound production of a sound which is newly keyed on.

In the embodiment, the case of ($2\times S+1=m$) is not explained; that is, the case where, in a stereophonic sound production, one oscillator is in excess, is not explained. The reason for this is that an even number of oscillators are provided at all times, because the electronic musical instrument of the invention is formed on the basis of stereophonic sound production.

If the number of sounds produced at the same time is gradually increased, then in an extreme situation it may be considered that only one sound which is newly produced is in a stereophonic mode, while all of the other sounds which have been produced are in a monophonic mode. In this case, S(stereophonic)=1, and M(monophonic)=m−2, and therefore the total number of sounds produced at the same time is (m−1).

When, in such an extreme situation, a key-on operation is further (newly) conducted, the following two methods may be employed: In one of the methods, two monophonic sounds which are earliest in sound production are stopped, and one sound is produced in a stereophonic mode. In the other method, one monophonic sound which is earliest in sound production is stopped, and one monophonic sound is newly produced.

However, this is for an extreme situation, and such an extreme situation scarcely occurs. Hence, any one of the two methods may be employed.

Now, the operation of the above-described embodiment will be described with reference to flow charts.

Figure 2:
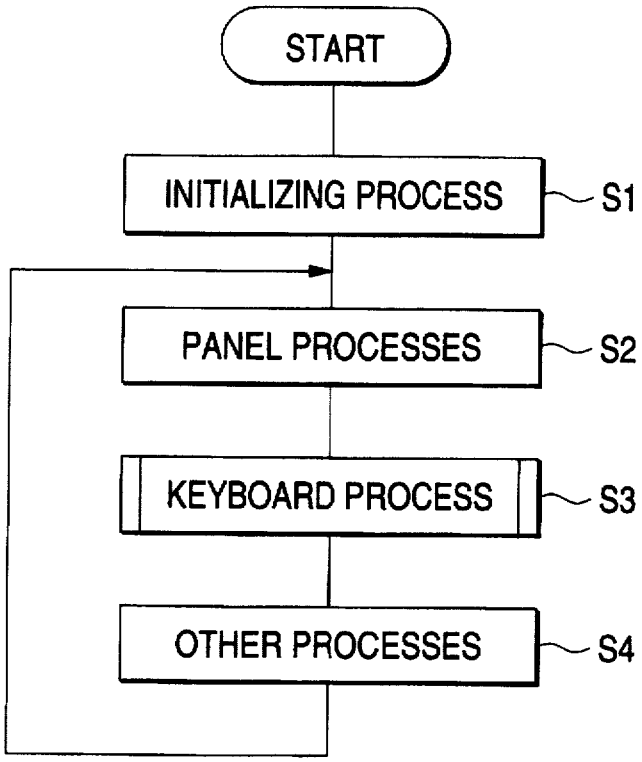
FIG. 2 is a main flow chart for a description of the operation of the electronic musical instrument.

FIG. 2 is a main flow chart indicating processes for the electronic musical instrument of the invention.

First, a reset signal is utilized for initializing the electronic musical instrument (Step S1). The reset signal is produced when the power switch is turned on or a reset switch (not shown) is depressed.

The initializing process is the process for the following. The internal states of the musical sound signal producing sections 9 are initialized to prevent the production of an unwanted sound when the power switch is turned on. The work area of the RAM 7 is cleared. In addition, data on tone color, sound volume, pointer, flag, register, and so forth are initialized.

Furthermore, in the initializing process, the number (S) of stereophonic sounds to be produced, and the number (M) of monophonic sounds to be produced are set to an initial value "0".

Next, a panel process is carried out (Step S2). In this process, the panel switches are set, thereby to set a tone color, sound volume, and so forth. For instance, the tone color of "piano" is switched over to that of "guitar", or the sound volume is changed to a desired value.

Thereafter, a keyboard process is carried out (Step S3). In the keyboard process, data on key-on and key-off operations are temporarily stored in the RAM 7. Those data are utilized for a key on/off process. The keyboard process includes the assignment of the oscillators, which will be described with reference to FIG. 3 later.

Under this condition, "other processes" are performed (Step S4). More specifically, the setting of the switches or keys which are detected in the panel process and in the keyboard process, is carried out. In addition, processes according to the assignment of oscillators are performed, such as the changing of a tone color or sound volume, the selecting of a rhythm, and the producing or stoppage of sounds in correspondence to key numbers.

When the above-described "other processes" (Step S4) are accomplished, Step S2 is effected again, so that the above-described operations are carried out all over again. Hence, functions are set up on the basis of the assignment of oscillators which is made in correspondence to the number of sounds produced at the same time in the keyboard process. And through the "other processes", a desired performance is played.

Figure 3:
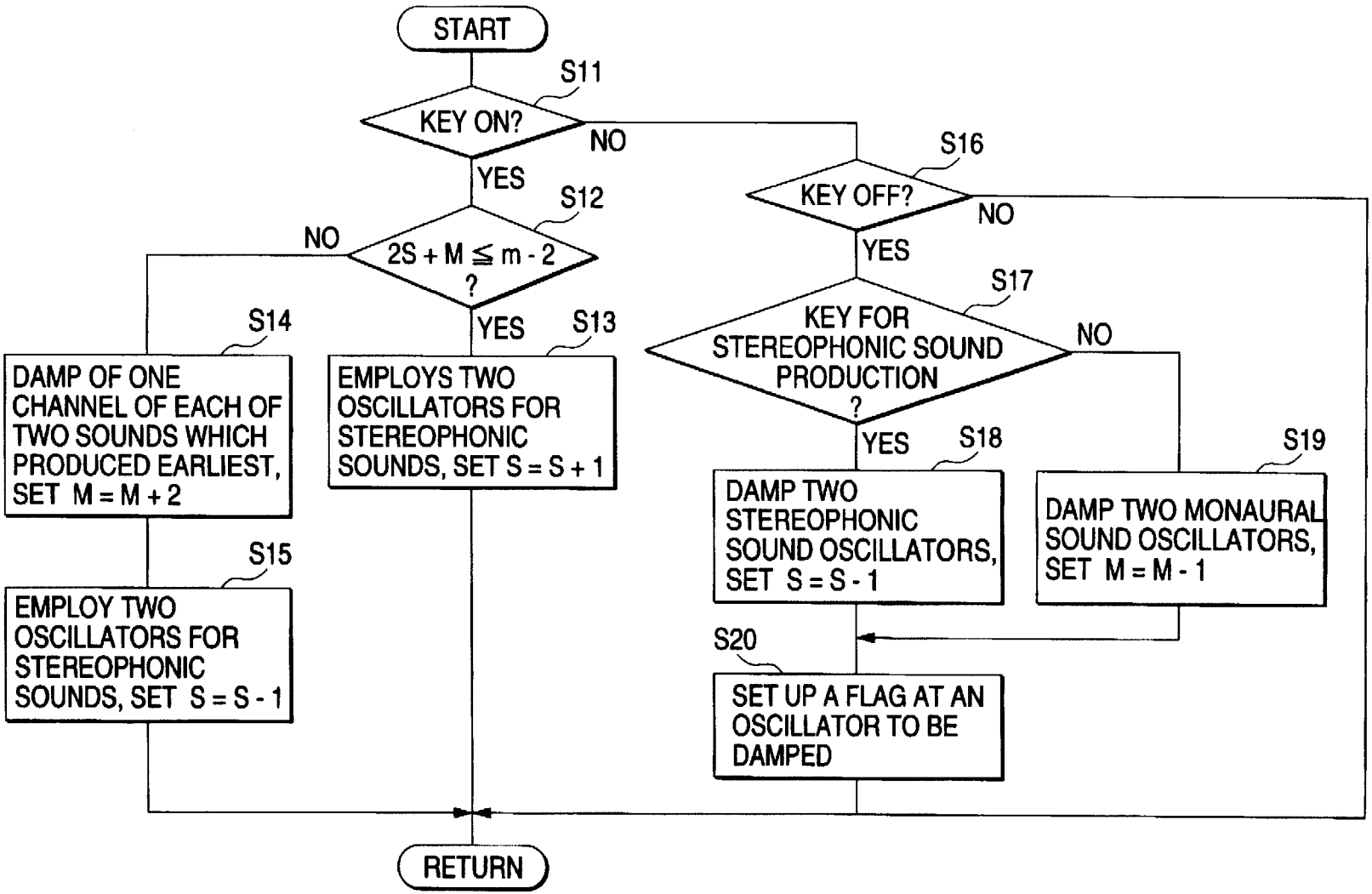
FIG. 3 is a flow chart for a description of the assignment of oscillators according to the invention.

In the keyboard process (Step S3) of the main routine (FIG. 2), the assignment of oscillators, which directly concerns the invention, will be described with reference to FIG. 3.

In the assignment of oscillators, first, it is detected whether or not an key-on event has occurred (Step S11); that is, the control section 22 reads the contents of new and old event buffers in the RAM 7. If it is determined that no key-on event has occurred, then Step S16 is effected.

Where, on the other hand, it is determined that a key-on event has occurred, it is detected whether or not the total number (2S+M) of oscillators which are producing sounds is smaller than the total number (m−2) of oscillators, in Step S12. That is, it is detected whether or not at least two oscillators are available which are not used for the production of sound.

When at least two oscillators are available which are not used, two of them are employed for the production of next stereophonic sounds, and the fact is recorded in the oscillator using status memory 23, while the number (S) of stereophonic sounds is set to (S+1). The data (S+1) is stored in the number-of-generated-sounds register 24 (Step S13). Under this condition, the main routine is effected again.

The data on the assignment of oscillators, which have been stored in Step S13, are read out with the predetermined timing in the "other processes (Step S4)" in the main routine, so that the sound production process is performed.

On the other hand, if, in Step S12, no oscillators are available and are not being used, in Step S14, the contents of the oscillator using status memory 23 is read, and a flag is set up for the two oscillators of the four oscillators for two stereophonic sounds which were produced earliest, to damp the two oscillators, while the two oscillators are erased from the oscillator using status memory 23. Also, if, in Step S12, one oscillator is available and are not being used, in Step S14, the contents of the oscillator using status memory 23 is read, and a flag is set up for the two oscillators of the four oscillators for two stereophonic sounds which were produced earliest, to preferentially damp two of four oscillators producing two stereophonic sounds than one oscillator producing one monophonic sound, while those oscillators are erased from the oscillator using status memory 23.

Accordingly, the number (M) of monophonic sounds of the number-of-produced-sound memory register 24 is set to M+2 (Step S14).

In the above-described Step S14, the right or left oscillator is damped according to the following two methods. For instance, in the case of a piano, a sound volume generated by the left oscillator is greater than the right oscillator when a sound in a low frequency range is keyed on, and a sound volume generated by the right oscillator is greater than the left oscillator when a sound in a high frequency range is keyed on. According to the case of the piano, one of the methods is that the right oscillator is damped in the case where a sound in a low frequency range has been keyed on because the right oscillator scarcely influences the tonal quality of the sound, and the left oscillator is damped in the case where a sound in a high frequency range has been keyed on because the left oscillator scarcely influences the tonal quality of the sound. In the other method, the numbers of sounds produced by the right and left oscillators are detected, and the oscillators which are larger in the number of produced sounds are damped.

Next, the two oscillators thus damped are assigned to a sound which is to be produced next in a stereophonic mode, and the assignment is written in the oscillator using status memory 23, and the number (S) of stereophonic sounds in the number-of-produced-sounds memory register 24 is set to S−1 (S=S−1) (Step S15). Under this condition, the main routine is effected again.

More specifically, two sounds of two stereophonic sounds are stopped and converted into monophonic sounds, and therefore the number (M) of monophonic sounds is set to M+2 (M=M+2). On the other hand, two sounds of two stereophonic sounds are stopped; however one stereophonic sound is produced, and therefore S=S−1.

The oscillator for which a flag is set up in Step S14, is damped in the "other processes" in the main routine, and assigned to a new stereophonic sound production.

On the other hand, in the case where no key-on operation is detected in the above-described step S11, then it is detected whether or not a key-off operation is effected (Step 16). This is achieved by reading the contents of the key event buffer. When it is determined that no key-off operation is effected, it is unnecessary to perform any process, and therefore the main routine is effected again.

On the other hand, in the case where, in Step S16, the key event is a key-off operation, it is detected whether or not the key keyed off is a key whose sound is being produced in a stereophonic mode (Step S17). That is, the control section 22 reads the contents of the oscillating using status memory 23.

In the case where the key keyed off is of stereophonic sound production, two oscillators which are producing stereophonic sounds are released, and they are erased from the oscillator using status memory 23, and (S=S−1) is set in the stereophonic sound memory in the number-of-produced-sounds memory register 24 (Step S18). Next, a flag is set up at a oscillator which is to be damped (Step S20). Then, the main routine is effected again.

Therefore, an oscillator at which a flag is set up in the "other processes" of the main routine is damped, and it is employed for a new stereophonic sound production.

On the other hand, in the case where, in Step S17, the key keyed-off is of monaural sound production, then the oscillator producing the monophonic sound is erased from the oscillator using status memory 23, and the number (M) of monophonic sounds in the number-of-produced-sounds memory register 23 is set to M−1 (Step S19). Then, Step S20 is effected. In Step S20, a flag is set up for an oscillator which is to be damped, and then the main routine is effected again.

As is apparent from the above description, in the musical sound producing device according to the invention, a small number of oscillators is effectively used, and the fact that the number of oscillators is small, scarcely affects the tonal quality thereof.

As was described above, in the musical sound producing device of the invention, the number of oscillators is not increased at all; however, the number of sounds which are produced at the same time can be increased without adversely affecting a musical performance.

In addition, the operation of the musical sound producing device is controlled according to the suitable program, and therefore it is unnecessary to improve its hardware so much. Accordingly, the musical sound producing device is small in the number of oscillators, and accordingly low in manufacturing cost.

What is claimed is:

1. A musical sound producing device in an electronic musical instrument of stereophonic sampling system, comprising:

oscillator using status memory means for storing each order of right and left oscillators which are being used for sound production, in accordance with an order of the sound production;

number-of-produced-sound memory means for storing each number of stereophonic sounds and a monophonic sound which are being produced at the same time by the oscillators memorized in the oscillator using status memory means; and oscillator assigning means for performing calculation in accordance with the numbers of the stereophonic sounds and the monophonic sound stored in the number-of-produced-sound memory means, stopping at least one sound being produced, by damping an oscillator, when a sound is newly keyed on under a condition that the number of oscillators which are being used reaches a total number of oscillators, and assigning the damped oscillator to produce the sound which is newly keyed on.

2. The musical sound producing device of claim 1, wherein when one stereophonic sounds are newly keyed on under the condition that the number of oscillators which is being used reaches the total number of oscillators, the oscillator assigning means switches two stereophonic sounds being produced over to two monophonic sounds to damp two oscillators, and assigns the two oscillators damped by switching to produce the stereophonic sounds which are newly keyed on.

3. The musical sound producing device of claim 1, wherein when the sound is newly keyed on under the condition that the number of oscillators which is being used reaches the total number of oscillators, the oscillator assigning means switches one stereophonic sounds being produced over to one monophonic sound, and assigns the oscillator damped by switching to produce the sound which is newly keyed on.

4. The musical sound producing device of claim 3, wherein the oscillator, which is damped when the oscillator assigning means switches the stereophonic sounds over to the monophonic sound and assigns the oscillator to produce the sound newly keyed on, is determined in accordance with a comparison of the number of oscillators which are producing right monophonic sounds with the number of oscillators which are producing left monophonic sounds.

5. The musical sound producing device of claim 3, wherein the oscillator, which is damped when the oscillator assigning means switches the stereophonic sounds over to the monophonic sound and assigns the oscillator to produce the sound newly keyed on, is determined in accordance with a frequency range of the stereophonic sounds.

6. A musical sound producing device in an electronic musical instrument of stereophonic sampling system, comprising:

a plurality of right and left oscillators producible stereophonic sounds and monophonic sounds, in accordance with a key operation;

an oscillator using status memory storable each order of right and left oscillators which are being used, in accordance with an order of sound production;

a number-of-produced-sound memory register storable each number of stereophonic sounds and monophonic sound which are being produced at the same time by the oscillators memorized in the oscillator using status memory; and an oscillator assigning section performable calculation in accordance with the numbers of the stereophonic sounds and the monophonic sound stored in the number-of-produced-sound memory register, stoppable at least one sound being produced, by damping an oscillator, when a key is newly operated under a condition that the number of oscillators which are being used reaches a total number of oscillators, and assignable the damped oscillator to produce a sound which is newly produced by the key operation.

7. The musical sound producing device of claim 6, wherein when one stereophonic sounds are newly keyed on under the condition that the number of oscillators which is being used reaches the total number of oscillators, the oscillator assigning section is switchable two stereophonic sounds being produced over to two monophonic sounds to damp two oscillators, and is assignable the two oscillators damped by switching to produce the stereophonic sounds which are newly keyed on.

8. The musical sound producing device of claim 6, wherein when the sound is newly keyed on under the condition that the number of oscillators which is being used reaches the total number of oscillators, the oscillator assigning section is switchable one stereophonic sounds being produced over to one monophonic sound, and is assignable the oscillator damped by switching to produce the sound which is newly keyed on.

9. The musical sound producing device of claim 8, wherein the oscillator, which is damped when the oscillator assigning section switches the stereophonic sounds over to the monophonic sound and assigns the oscillator to produce the sound newly keyed on, is determined in accordance with a comparison of the number of oscillators which are producing right monophonic sounds with the number of oscillators which are producing left monophonic sounds.

10. The musical sound producing device of claim 8, wherein the oscillator, which is damped when the oscillator assigning section switches the stereophonic sounds over to the monophonic sound and assigns the oscillator to produce the sound newly keyed on, is determined in accordance with a frequency range of the stereophonic sounds.

11. The musical sound producing device of claim 6, wherein the oscillator, which is damped when the oscillator assigning section switches the stereophonic sounds over to the monophonic sound and assigns the oscillator to produce the sound newly keyed on, produces the earliest one of the sounds which are being produced.

12. A musical sound producing device in an electronic musical instrument of stereophonic sampling system, comprising:

a plurality of oscillators producible stereophonic sounds and/or monophonic sounds;

an oscillator using status memory storable a using status of the oscillators;

an oscillator assigning section, when a key-on information newly occurs under a condition that the using status stored in the oscillator using status memory indicates that the number of oscillators which are being used reaches substantially a total number of the oscillators, performable to preferentially damp one of first and second oscillators producing one stereophonic sounds than an oscillator producing one monophonic sound and to assign the damped oscillator to produce a sound based on the key-on information.

13. The musical sound producing device of claim 12, wherein when one stereophonic sounds are newly keyed on under the condition that the number of oscillators which is being used reaches substantially the total number of oscillators, the oscillator assigning section is switchable two stereophonic sounds being produced over to two monophonic sounds to damp two oscillators, and is assignable the two oscillators damped by switching to produce the stereophonic sounds which are newly keyed on.

14. The musical sound producing device of claim 12, wherein when the sound is newly keyed on under the condition that the number of oscillators which is being used reaches substantially the total number of oscillators, the oscillator assigning section is switchable one stereophonic sounds being produced over to one monophonic sound, and is assignable the oscillator damped by switching to produce the sound which is newly keyed on.

15. The musical sound producing device of claim 14, wherein the oscillator, which is damped when the oscillator assigning section switches the stereophonic sounds over to the monophonic sound and assigns the oscillator to produce the sound newly keyed on, is determined in accordance with a comparison of the number of oscillators which are producing right monophonic sounds with the number of oscillators which are producing left monophonic sounds.

16. The musical sound producing device of claim 14, wherein the oscillator, which is damped when the oscillator assigning section switches the stereophonic sounds over to the monophonic sound and assigns the oscillator to produce the sound newly keyed on, is determined in accordance with a frequency range of the stereophonic sounds.

17. The musical sound producing device of claim 12, wherein the oscillator, which is damped when the oscillator assigning section switches the stereophonic sounds over to the monophonic sound and assigns the oscillator to produce the sound newly keyed on, produces the earliest one of the sounds which are being produced.

* * * * *